United States Patent [19]

Winter

[11] Patent Number: 4,874,119

[45] Date of Patent: Oct. 17, 1989

[54] TOOL PACK APPARATUS

[76] Inventor: Robert W. Winter, 1530 Eisenhower, #242, Boulder, Colo. 80303

[21] Appl. No.: 267,229

[22] Filed: Nov. 4, 1988

[51] Int. Cl.[4] ..... A45F 3/02; A47B 81/00

[52] U.S. Cl. ..... 224/202; 224/257; 312/289; 312/DIG. 33; 206/373; 190/110

[58] Field of Search ..... 224/202, 206, 207, 257; 206/372, 373, 315.11; 312/289, DIG. 33; 43/54.1; 190/110

[56] References Cited

U.S. PATENT DOCUMENTS

| | | | |
|---|---|---|---|
| 1,133,866 | 3/1915 | Leighty | 312/289 X |
| 2,501,879 | 3/1950 | Sulentic | 206/373 X |
| 3,549,064 | 12/1970 | Wilson | 224/202 X |
| 4,195,889 | 4/1980 | Coyne | 312/240 |
| 4,303,158 | 12/1981 | Perkins | 206/373 |
| 4,386,642 | 6/1983 | Durbin | 150/34 |

FOREIGN PATENT DOCUMENTS

| | | | |
|---|---|---|---|
| 764061 | 12/1956 | United Kingdom | 312/DIG. 33 |

*Primary Examiner*—Henry J. Recla
*Assistant Examiner*—Robert M. Fetsugea
*Attorney, Agent, or Firm*—Timothy J. Martin; J. Preston Oxenham

[57] ABSTRACT

A tool pack has a shape retaining shell enclosing a tool protective compartment. The shell includes first and second door members and a lid member which can pivot from a closed position, backward, to an open position. When the door and lid members are in the open position, the door members can be attached to the lid member to form a rigid structure. When in the open position and attached, the base of the door members prevents the pack from tipping backward and an inside surface of the lid member provides a stable work surface. The tool pack includes a removable shelf member and a small shelf pouch which can be attached to the shelf member. The shelf member may be installed in the tool protective compartment in a first position to form an open-ended cell for confinement of objects stored beneath the shelf or installed in a second position in which the space beneath the shelf is readily accessible. The shelf pouch has a base panel with a dimension larger than a dimension of the shelf member and means for releasably attaching edges of the base panel adjacent edges of a shelf surface so that objects can be stored beneath the base of the shelf pouch when it is attached to the shelf member.

54 Claims, 8 Drawing Sheets

TOOL PACK APPARATUS

BACKGROUND OF THE INVENTION

When man first began to distinguish himself from the other animals by his use of tools, his implements were few and simple. Setting forth from this cave on a hunting expedition, his only tool might be a single stone carried in his hand.

As technology has developed, artisans in each field have progressively developed greater and greater numbers of tools to perform ever more specific tasks in assembling and repairing increasingly complex electrical and mechanical equipment. Repair technicians, such as those responsible for the maintenance of heating, air conditioning and ventilating equipment, must often set forth in response to trouble calls to repair highly complex systems with little knowledge of the nature of the failure or the procedures which will be required to restore service. Under such circumstances, it is desirable to have a large assortment of tools and supplies available to enable a technician to perform any of a wide assortment of possible repair procedures once he has reached the repair site.

Often, repairs must be performed in adverse environmental conditions and in locations which are difficult to access and offer limited space in which to work with no work surface upon which to perform close, detail work on small components. Where work is performed indoors, dampness and standing water may be encountered when system failure has resulted from severe weather conditions. Where repairs are performed outdoors, or in uncompleted structures, not only standing water, but also falling rain or snow may have to be contended with. Under such conditions, technicians need a tool pack which will allow them to carry a large assortment of tools and supplies in a compact package which will not encumber their ability to negotiate difficult access to locations where repair work must be performed, will protect tools and supplies from water and other damaging elements, will facilitate the organization of tools and supplies for ready access as needed in the course of performing repairs, and will provide an adaptable work surface for performing detail work in an otherwise unaccommodating work space.

Tool kits which are presently available are generally encumbering and unaccommodating for use in difficult work spaces of limited access and size. Generally, they are hand held and leave only one hand free to assist in accessing difficult repair sites, for example, by climbing a ladder. They lack versatility of configuration in their tool arrangement, both short and long term, to adapt to particular needs in repairing different types of equipment under different circumstances and to accommodate personal taste and preferences of the user. Once brought to the repair site, they cannot provide a work surface in difficult environments adequate for the performance of close detail work and facilitating containment of small parts. Many provide little or no protection of tools and equipment from falling rain or from water which may accumulate on limited surface areas available for support of the tool kit at the repair site.

SUMMARY OF THE INVENTION

It is an object of the present invention to provide a tool pack which is very versatile and adaptable for use in many different work environments and for use by individual users according to their personal preference and taste.

It is a further object to provide a tool pack which is not encumbering during transit and allows both hands of a user to be free for accessing difficult work locations.

A further object is to provide a tool pack which can provide a stable work surface which will assist in confining small parts and which is suitable for performing fine, detailed work in confined, unaccommodating work locations.

An additional object is to provide a tool pack which is durable and will protect its contents from both falling rain and standing water which has accumulated on surfaces on which the pack must set at a repair site.

The tool pack of the present invention comprises a shape retaining, generally rectangular, box-like outer shell. The outer shell includes a first door member and a second door member, each door including a side panel and a front panel of the shell, and pivotally joined to a respective edge portion of a back panel of the shell. A lid member includes a top panel of the shell and is pivotally attached to a top edge of a back panel of the shell at the lid's back edge. When the first door member, second door member, and lid member are in a closed configuration, they form, together with the back panel and a bottom panel, the box-like shell enclosing a tool protective compartment.

The lid member, first door member and second door member may each be rotated approximately 180 degrees from the closed configuration, in which they extend from a front of the back panel, to a position extending from the back of the back panel, to define an open configuration. When in the open configuration, a top edge portion of the first and second door members each lie adjacent a first and second edge portion, respectively, of the lid member. Means for releasably attaching the top edge portions of the first and second door members to the first and second edge portion of the lid member, respectively, is provided. When the top edge portions of the first and second door members are attached to the first and second edge portions of the lid member, a rigid structure is formed supporting the top panel in a generally inverted, horizontal position in which it may serve as a work surface.

When the lid and first and second doors are in the closed configuration, the top panel extends beyond the front, back, first and second side panels. In that configuration, a continuous perimeter skirt, which extends downwardly from the edges of the top panel, prevents falling rainwater from entering the tool protective compartment of the pack. When the lid is in the open configuration and used as a work surface, the skirt serves as a retention device to confine small items and prevent them from being lost from the work surface.

In a first embodiment, the bottom panel of the pack shell has a continuous wall extending upwardly from its edges. The wall, together with the bottom panel, forms a vessel to prevent water from entering the interior of the pack when it is resting on a surface upon which standing water has accumulated. When the first and second door panels are in the closed configuration, their bottom edge portions lie on the outside of the edges of the bottom panel, and below the top edge of the wall, so that falling rainwater does not enter the interior of the pack. In a second embodiment, flanges extend downwardly from the perimeter of the bottom panel to support the bottom panel above the level of any water which has accumulated on the supporting surface.

Holders, for holding work items such as tools, supplies and the like, are releasably attached to the interior walls of the front panel, first and second side panels and back panel. These holders may be of the nature of pouches with multiple cells for holding small tools and parts in an organized manner, and a variety of tool holder configurations may be made interchangeable to adapt the tool pack to different needs.

A shelf element is also provided, having a shelf panel and a supporting panel joined along a corner edge. The shelf element has a flange extending upwardly from a distal edge of the shelf panel. A means is provided for releasably attaching the flange to the interior of the back panel. When the flange is attached to the back panel of the pack, a foot edge of the support panel rests on a forward portion of the bottom panel of the pack so that the flange and support panel together support the shelf panel in a generally parallel relation to the bottom panel. Means are also provided for releasably attaching a portion of the support panel adjacent the corner edge to the back panel. When the adjacent portion of the support panel is attached to the back wall, with the support panel adjacent the back panel and the foot edge of the support panel resting on a back portion of the bottom panel, the shelf panel is supported in a generally horizontal position and extends away from the back panel to its flanged edge.

A small shelf pouch may be provided for retaining articles on the shelf panel. The shelf pouch has a base panel with an edge to edge dimension larger than an edge to edge dimension of the shelf panel, and hyperextended attachment hems along a first and second edge of the base panel. Means are provided for releasably attaching the hyperextended hems along the first and second edge of the base panel to a portion of the support panel adjacent the corner edge and to the flange, respectively. When the hems are so attached, due to the larger edge to edge dimension of the shelf pouch base panel, objects may be placed on the shelf panel beneath the base panel of the pouch.

These and other features of the present invention will be more fully appreciated and understood upon consideration of the detailed description of the preferred embodiment below together with the accompanying drawings in which:

DETAILED DESCRIPTION

The present invention relates to tool packs for organizing, protecting and transporting work items such as tools and supplies for use at repair locations by technicians, in general, and to tool packs for use by technicians in the installation and repair of heating, ventilating, air conditioning, and related systems, in particular. An exemplary preferred embodiment of the present invention provides a compact protective shell defining a tool protective compartment. Removable tool holders attach to the interior walls of the compartment and maintain work items in an organized relationship for display and ready access for use once the work location is reached. A lid of the protective shell provides an adaptive, stable work surface at remote locations.

Figure 1:
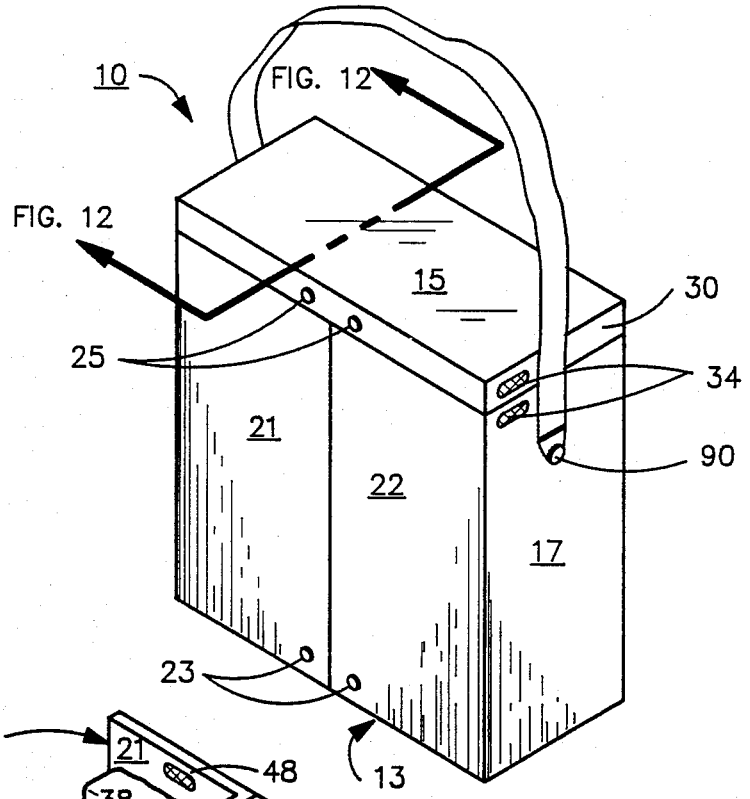
FIG. 1 is a perspective view of an exemplary preferred embodiment of the tool pack in its closed configuration.
Figure 2:
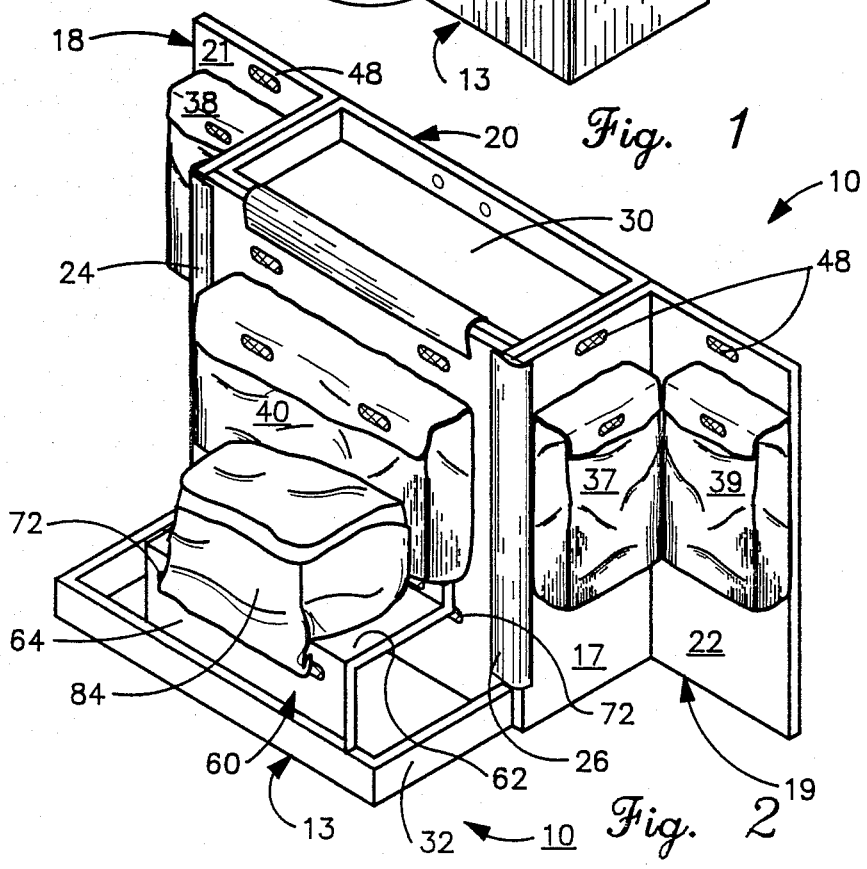
FIG. 2 is a perspective view of the exemplary tool pack in its open configuration showing tool holders mounted on the interior surfaces of the front, side and back panels and the shelf element positioned with the foot edge of the support panel resting on a forward portion of the bottom panel.
Figure 3:
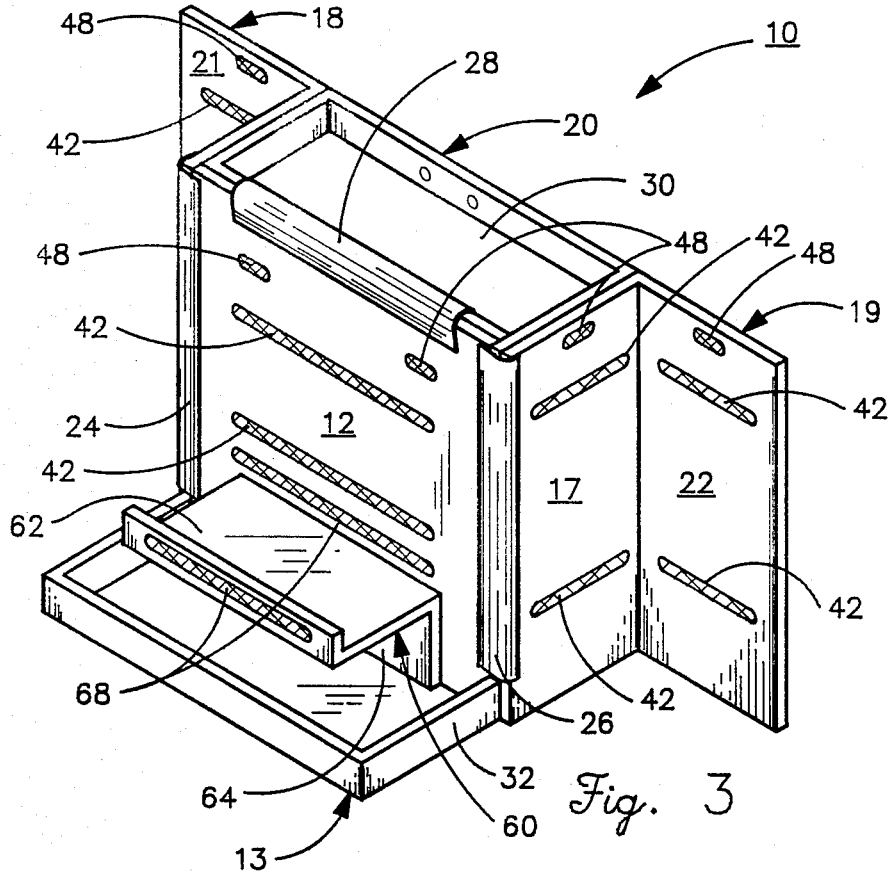
FIG. 3 is a perspective view of the exemplary tool pack in the open configuration with tool holders removed and the shelf element positioned with the support panel adjacent the back panel.

An exemplary tool pack comprising the present invention is illustrated in FIGS. 1–3. Referring to those figures, the exemplary tool pack 10 of the present invention includes a shape retaining, generally rectangular, box-like outer shell having a back panel 12, a bottom panel 13, first and second front panels 21, 22, a top panel 15, and first and second side panels 16, 17. The protective outer shell may be manufactured of any suitably rigid material, for example, aluminum. Where chemical or electrical hazards of the environment are of particular concern, the shell may be manufactured of non-electrically conductive and chemically inert material, for example, ultraviolent stabilized ABS plastic. While the exemplary embodiment 10 of the illustrations is of a box-like shape with generally flat surfaced panels and a rectangular plan form, it should be understood that the tool pack may be of any suitable shape and plan form. An embodiment of the tool pack might have, for example, rounded or octagonal corners and a slanted top.

The protective outer shell of the exemplary embodiment 10 includes door members 18 and 19 and lid member 20 and is shown in a closed configuration in FIG. 1 and an in open configuration in FIGS. 2 and 3. Door members 18 and 19 each include a side panel 16, and 17 respectively, and a front panel, 21 and 22 respectively, which are joined at a right angle to form a front corner. In the exemplary preferred embodiment of FIGS. 1–3, door members 18 and 19 are pivotally attached to side edge portions of back panel 12 by, for example, piano hinges or flexible plastic hinge strips, 24 and 26, respectively, so that the door members 18, 19 may pivot from the closed configuration of FIG. 1, in which side panels 16 and 17 extend forward from back panel 12, through an angle of about 180 degrees to an open configuration in which side panels 16 and 17 extend backwardly from back panel 12 at an angle of about 90 degrees, as illustrated in FIGS. 2 and 3. The back edge of lid member 20 of the outer shell is pivotally attached to a top edge portion of back panel 12 by a hinge 28, which may be, for example, a flexible plastic strip or a piano hinge, so that it may rotate between its position in the closed configuration of FIG. 1, in which lid 20 extends at an angle of generally 90 degrees from back panel 12, through an angle of 180 degrees to its position in the open configuration of FIGS. 2 and 3, in which the lid 20 extends backwardly from back panel 12 at an angle of generally 90 degrees.

Figure 4A:
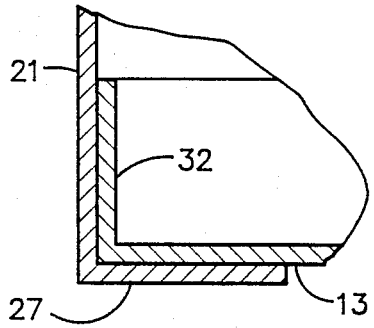
FIG. 4*a* and *b* is a broken out sectional view showing backward extending flanges of front door panels in the closed configuration.
Figure 4B:
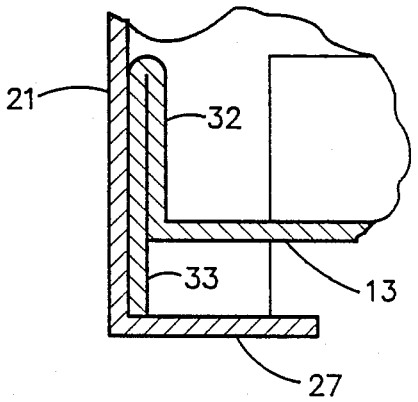

When door members 18 and 19 of the exemplary embodiment are in the closed configuration, releasable latches 23, which may be of any one of many types well known to those in the art, may be utilized to maintain the inner edges of front panels 21 and 22 in an abutting relationship to provide a continuous panel at the front of the tool pack. Preferably, latches 23 also releasably attach door panels 21 and 22 to bottom panel 13 to help support bottom panel 13 during transport. Alternatively, a fixed center panel may be provided at the front of the pack to which door members 21 and 22 can be releasably attached by any of a number of conventional latching devices. Additional support for bottom panel 13 may be provided by backwardly extending flanges 27 formed on the bottom edges of front panels 21, 22 which extend beneath the front edge of bottom panel 13 when door members 18, 19 are in the closed configuration, as shown in FIG. 4*a* and 4*b*. Releasable latches 25 may also be utilized to retain lid 20 in its closed position with a forward edge adjacent the top edges of front panels 21 and 22 of doors 18 and 19.

Figure 5:
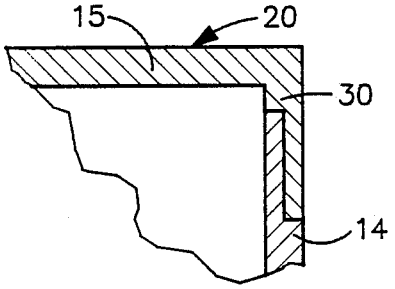
FIG. 5 is a broken out sectional view showing channeled joint between the lid and front panel.

When the lid 20 and door members 18 and 19 are in the closed configuration, they define, together with back panel 12 and bottom panel 13, an enclosed tool protective compartment. When the exemplary tool pack 10 is in the closed configuration, the top panel 15 of lid 20 extends beyond the planes of front panels 21 and 22, back panel 12 and side panels 16 and 17 and lid 20 comprises a continuous perimeter skirt 30 which extends downwardly from the edges of top panel 15 on the outside of the front panels 21 and 22, back panel 20 and side panels 16 and 17. Thus, lid 20 overlaps the top edges of door members 18 and 19 to assure that falling rain cannot introduce water into the tool protective compartment of tool pack 10 when it is in the closed configuration. This result may be achieved while, nonetheless, providing a flush outer surface of the protective shell at the base of lid 20 by machining a channel in the outer upper edges of the doors 18 and 19 and a mating channel on the inner lower edge of skirt 30 of lid 20 as is shown in the broken-out sectional detail of FIG. 5.

Figure 6A:
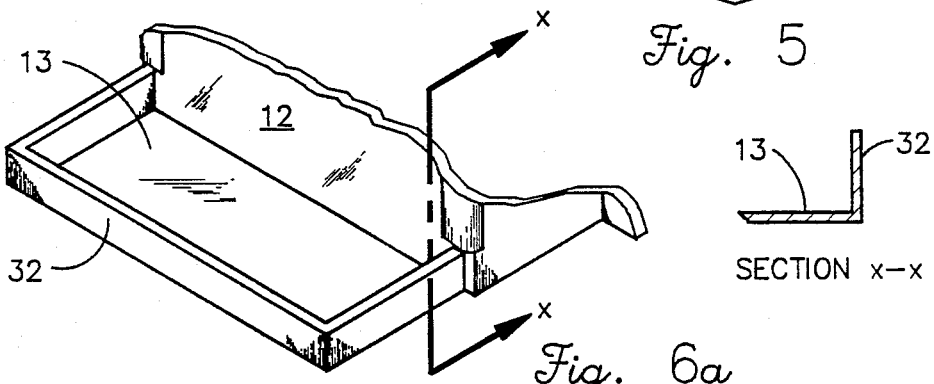
FIG. 6*a, b, c* are partial perspective views of the bottom panel of the tool pack, together with broken out sectional views, showing the perimeter wall, and, in 6*b* and *c*, the downward extending flange at the perimeter of the bottom panel.
Figure 6B:
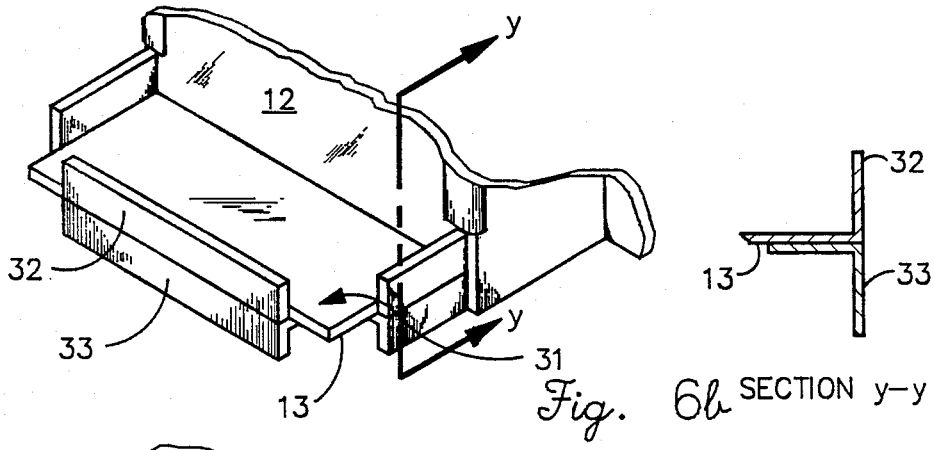
Figure 6C:
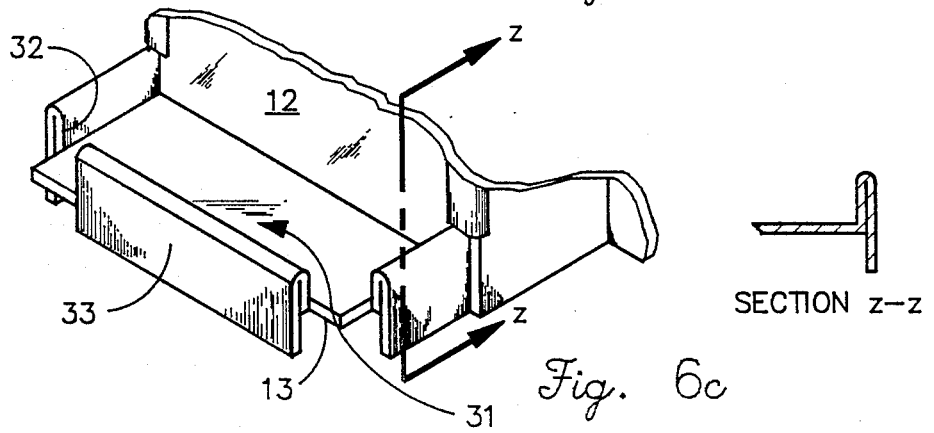

Similarly, bottom panel 13 of the exemplary embodiment of tool pack 10 has a continuous perimeter wall 32 which extends upwardly from the front, back and two side edges of bottom panel 13. Perimeter wall 32 and bottom panel 13, together, form a vessel to withhold water which may have accumulated and be standing on a surface upon which the tool pack is set for support at a work location, as may be best seen in FIG. 6*a*. Wall 32 also prevents tools and supplies which may be placed on the upper surface of bottom panel 13 from rolling or being pushed off of the surface. In an alternative embodiment, downwardly extending flanges 33 may be provided at the perimeter of bottom panel 13 to elevate bottom panel 13 above a supporting surface and thereby prevent water standing on the surface from entering the tool protective compartment. Downwardly extending flanges 33 may be formed by attaching angle pieces to bottom panel 13, as shown in FIG. 6*b*, or by bending the edges of bottom panel 13 downward, or first upward to form a wall 32 and then downward to form flange 33 as shown in FIG. 6*c*. When such downward extending flanges are provided together with perimeter wall 32, scuppers 31 may be provided in the perimeter wall 32 to allow rain water which may enter the tool protective compartment while the tool pack is in the open configuration to drain from the upper surface of bottom panel 13. Similar scuppers might also be provided in perimeter skirt 30 to allow rain water to drain from the work surface provided by top panel 15 when the tool pack is in the open configuration.

Preferably, side panels 16 and 17 and front panels 21 and 22 of door members 18 and 19 extend downwardly to a point below an upper edge of perimeter wall 32, overlapping wall 32 in such a manner that falling rainwater will not enter the tool protective compartment of tool pack 10 when it is in the closed configuration. In the exemplary embodiment, door members 18, 19 extend downwardly to the plane of bottom panel 13 to contact a supporting surface upon which tool pack 10 may be set to provide additional support to lid 20 and allow tool pack 10 to be used as a stool, or otherwise to support heavy loads when in the closed configuration.

Figure 7A:
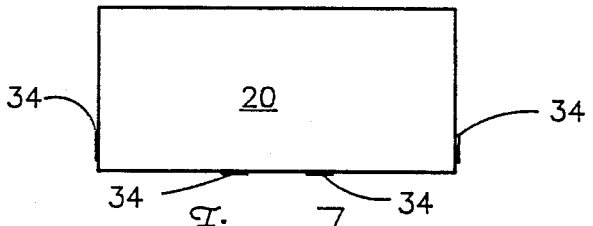
FIG. 7*a, b*, and *c* are schematic plan views of the tool pack showing the door members of the exemplary tool pack in a closed, intermediate and open configuration, respectively.
Figure 7B:
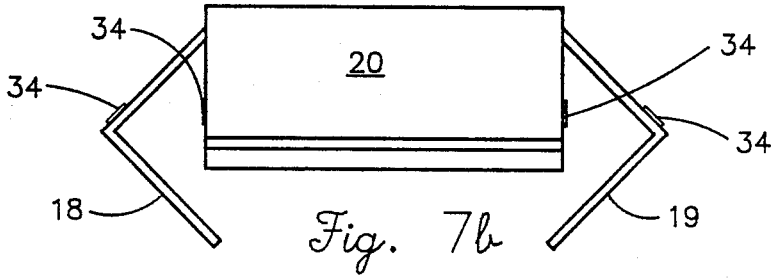
Figure 7C:
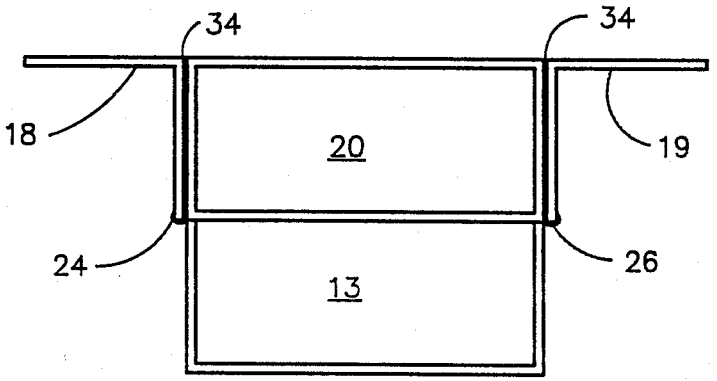

In the exemplary preferred embodiment, to provide a stable work surface at a work location, releasable attachment means 34 are provided at the forward side corners of perimeter skirt 30 of lid 20 and the forward upper front corners of side panels 16 and 17 of doors 18 and 19. As is best shown in the schematic plan views of FIGS. 7*a*, 7*b* and 7*c*, when tool pack 10 is in its open configuration, with lid 20 and door members 18 and 19 in their open positions, the forward side corners of lid 20 may be attached to the upper front corners of side panels 16 and 17, to fix the doors 18 and 19 and lid 20 in a rigid structural relationship. This allows the inner surface of top panel 15 to be utilized as a stable, flat work surface. In the exemplary embodiment, door members 18 and 19 extend downward to a bottom edge lying in a common plane with bottom panel 13, and, as may be seen best in FIG. 7, when door members 18 and 19 are in the open position the base area of tool pack 10 is increased with door members 18 and 19 assisting in preventing the tool pack 10 from tipping backward. When the tool pack 10 is in the open configuration, perimeter skirt 30, surrounding top panel 15, serves as a barrier to confine small objects and tools and prevent them from becoming lost by rolling or being pushed off the edges of the work surface.

Figure 8:
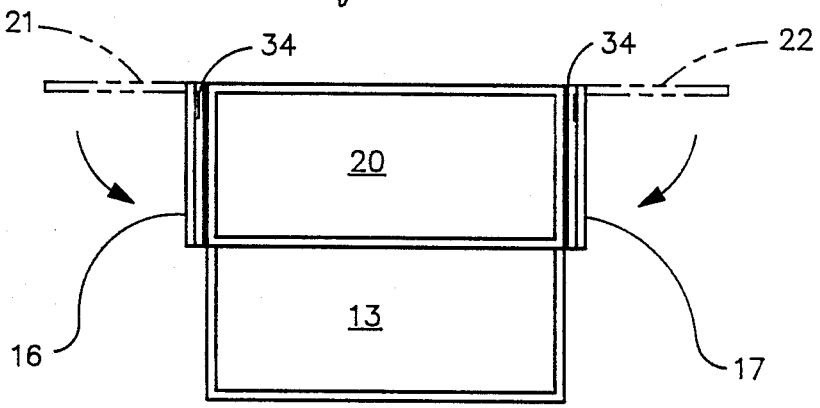
FIG. 8 is a plan view of a second exemplary embodiment in the open configuration, showing a reduction in base area when front panel portions of the door members are folded adjacent the side panels.

A second exemplary embodiment of tool pack 10 is shown in FIG. 8. To accomodate space restricted work environments, or to provide a smaller adjustable base area, when tool pack 10 must be utilized to provide a stable work surface while resting on uneven ground or other non-uniform support surface, this second embodiment includes pivoting attachment means at the forward corners of door members 18 and 19, where side panels 16 and 17 are joined to front panels 21 and 22, respectively, to allow front panels 21 and 22 to be folded from a position normal to side panels 16 and 17, shown by phantom lines in FIG. 8, to positions adjacent side panel portions 18 and 19, respectively, shown by solid lines in FIG. 8, when the tool pack 10 is in the open configuration.

Figure 9:
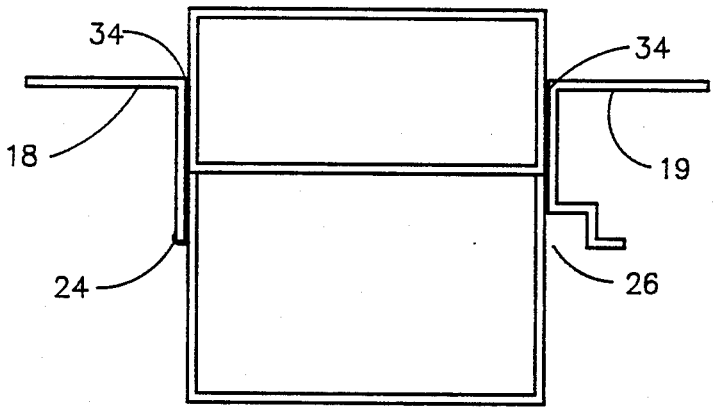
FIG. 9 is a plan view of a third exemplary embodiment in the open configuration showing hinge strips of door members forward of the plane of the back panel.

In an alternative embodiment, a forward extending edge portion may be provided on back panel 12 to provide rigid back corners to stiffen back panel 12 and strengthen the structure of the outer shell. In this case, the forward extending edge portions form a back portion of side panels 16 and 17 and hinge strips 24 and 26 are located forward of the plane of back panel 12, as illustrated in FIG. 9.

The protective compartment of tool pack 10 is provided with holders for holding work items such as tools and supplies. The interiors of side panels 16 and 17, front panels 21 and 22, and back panel 12 of the exemplary embodiment are equipped with tool holders 36, 37, 38, 39 and 40, respectively. Tool holders 36, 37, 38, 39 and 40 are attached to panels 16, 17, 21, 22 and 12 by releasable attachment means 42, as best shown in FIG. 3 in which tool holders 36, 37, 38 39, and 40 are shown as removed from the tool pack 10. Such fastening means might be, for example, hook and loop fasteners.

Figures 10A, 10B, 10C:
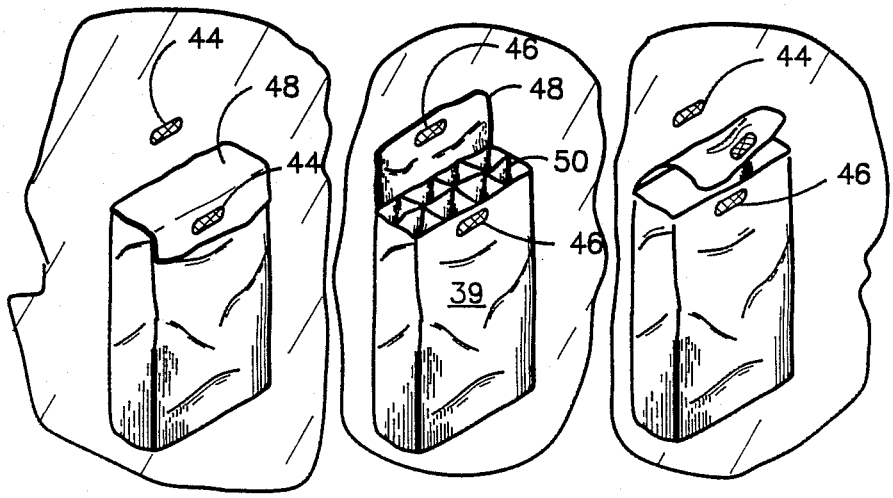
FIG. 10*a, b*, and *c* is a perspective view of an exemplary side panel tool holder.
Figure 11A:
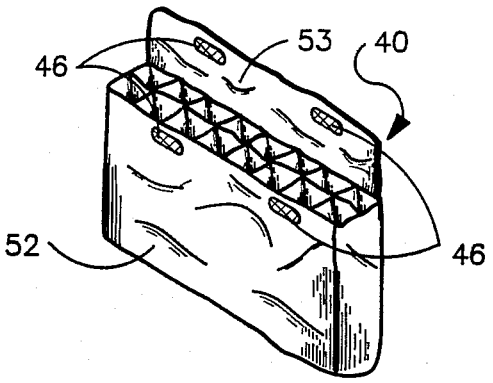
FIG. 11*a, b*, and *c* is a front plan view of an exemplary back panel tool holder.
Figure 11B:
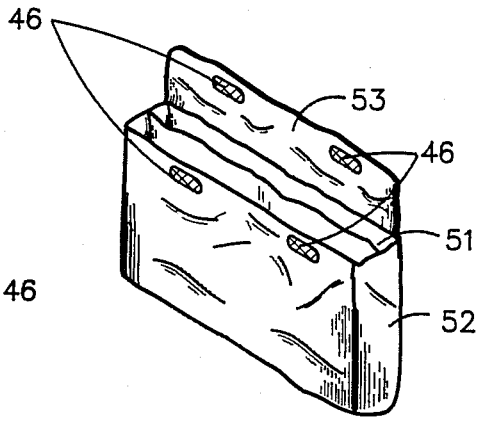
Figure 11C:
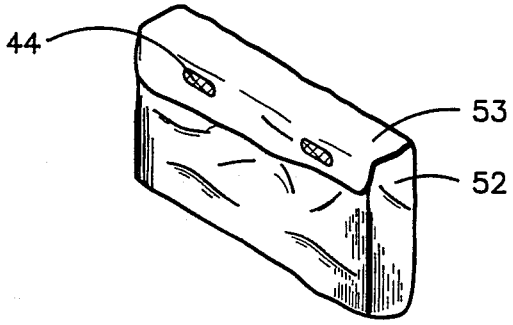

Typical tool holders of the exemplary embodiment of FIGS. 1–3 are shown in FIGS. 10 and 11. FIG. 10 is a perspective view of a side panel tool holder such as holder 39. FIG. 10*a* shows tool holder 39 in a closed configuration. Tool holder 39 includes a pouch-like body 47 with an open upper end over which flap 49 may close. The interior of the tool holder may be a single cell as shown in FIG. 10*c* or may be divided into a number of smaller cells 50 as shown in FIG. 10*b* to allow sorting and arrangement of small supplies and tools, such as wrenches and the like. Releasable attachment means 44 is provided on the exterior surface of a tool holder flap 49 to releasably attach the flap 49 to side panel 17 and retain the flap 49 in an open position, as shown in FIG. 10*c*, for easy access. FIG. 10 shows a typical tool holder 40 for use on back panel 12, which includes pouch-like body 52 and flap 53. Tool holder 40 may have an open single cell interior or may be divided into a number of cells suitable for particular purposes. FIG. 11*a* shows the interior of tool holder 40 divided into small cells for organization of repair materials or small tools, such as wrenches. As shown in FIG. 11*b*, the interior of tool holder 40 might also be divided into elongated cells 51, suitable to store repair manuals and the like. FIG. 11*c* shows tool holder 40 with flap 53 in the closed position. Releasable attachment means 44 are provided on flap 53 for holding flap 53 open against back panel 12. Tool holders 36, 37, 38, 39 and 40 are preferably made of a durable fabric, such as, for example, canvas or nylon.

By utilizing removable attachment means to attach tool holders to the interior of the shell panels, the usefulness and versatility of tool pack 10 is improved by greater adaptability to work requirements, environmental circumstances and individual preferences of the user. A number of tool holders having differing configurations for accommodating a variety of work items, such as tools of various types and sizes, repair manuals, and large and small parts and supplies which are needed for different repair procedures, may be made interchangeable for use on a given panel. In addition to fabric tool holders having interior cells of varying sizes, alternate holders, for example, made of rigid materials such as plastic, and including means for clamping or hooking particular tools in organized arrays, may be employed. Also, any or all of the tool holders may be removed when it is necessary to carry large items in the pack.

Figure 12A:
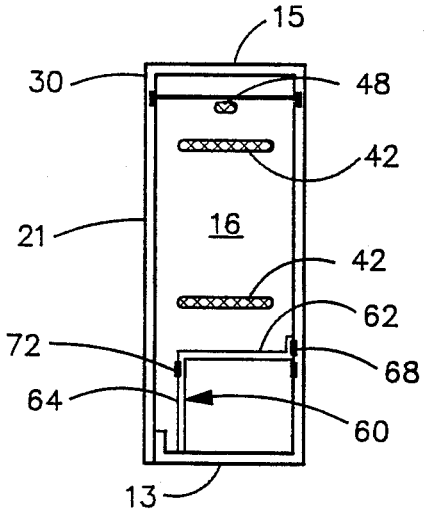
FIG. 12*a* and *b* is a sectional view of the exemplary tool pack of FIG. 1 taken along the plane of cutting line IX—IX and showing the shelf element positioned with the flange attached to the interior surface of the back panel, and showing the shelf element positioned with the support panel adjacent the back panel of the exemplary tool pack.
Figure 12B:
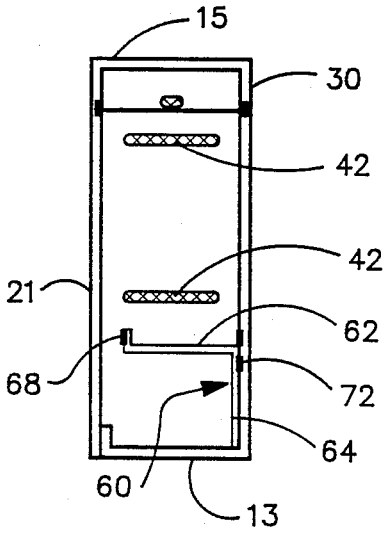

Further versatility of the interior configuration of the exemplary preferred embodiment of tool pack 10 is achieved by providing a shelf element 60 which allows storage of tools and materials beneath and upon a shelf panel 62. In the exemplary tool pack 10, shelf element 60 includes shelf panel 62 and supporting panel 64 which are joined at a right angle at a corner edge. Shelf panel 62 has a flange 66 formed along its back edge which extends normal to shelf panel 62. A means 68 for releasably attaching flange 66 of shelf panel 62 of shelf element 60 to back panel 12 is provided. In the exemplary embodiment, the releasable attachment means 68 may comprise, for example, a hook and loop fastener. When shelf element 60 is in a first position, the flange 66 of shelf element 60 is attached to back panel 12 and the width of shelf panel 62 is such that a foot edge of support panel 64 rests on a forward portion of bottom panel 13, as shown in FIG. 12*a*. Thus, when the tool pack 10 is in an upright position, the attachment means 68, together with support panel 64, may support shelf panel 62 generally above and parallel to bottom panel 13 with a load resting on shelf panel 62. In the exemplary preferred embodiment of FIGS. 1–3, a releasable attachment means 72, for example, a hook and loop attachment strip, is also provided on support panel 64 adjacent the corner edge at which support panel 64 and shelf panel 62 meet. Hook and loop attachment strip 72 of back panel 12 of the exemplary preferred embodiment is made sufficiently wide that when shelf element 60 is placed in a second position, with support panel 64 adjacent to back panel 12 so that the foot edge of support panel 64 rests upon the bottom panel, as shown in FIG. 12*b*, shelf panel 62 is supported extending away from back panel 12 at a generally parallel to bottom panel 13 forward to flange 66. In the first position, shelf element 60 provides a confined space to restrain items placed under the shelf panel 62. In the second position, shelf element 60 provides greater access to the area beneath shelf panel 62. Shelf element 60 may be made of any rigid material such as, for example, aluminum, or a nonconductive, chemically inert material, for example, ultraviolet stabilized ABS.

Figure 13A:
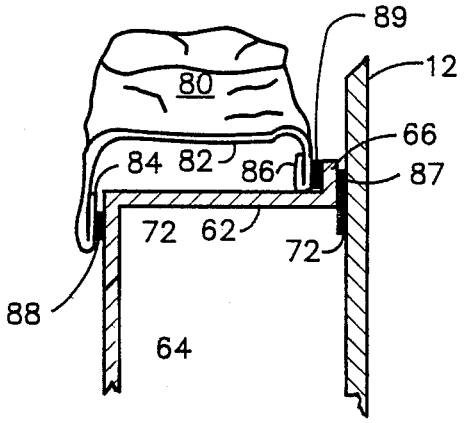
FIG. 13*a* and *b* is an elevation end view of the small shelf pouch mounted on the shelf element of the exemplary tool pack when the shelf element is in its first or second position, respectively.
Figure 13B:
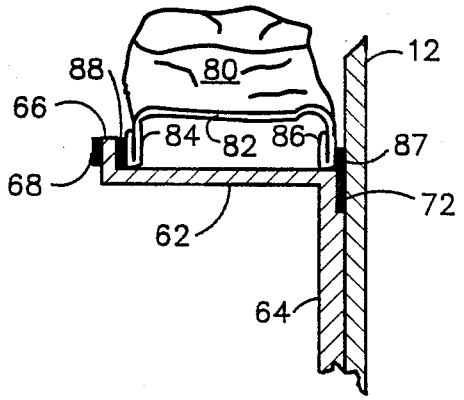

In the exemplary embodiment, a shelf pouch 80 is provided for use with the shelf element 60. As is most clearly shown in FIG. 13, shelf pouch 80 has a base panel 82 which has a dimension from a forward edge of panel 82 to a back edge of panel 82 which is greater than a dimension of shelf panel 62 from the corner edge of shelf element 60 to flange 66. Means are provided for releasably attaching the forward edge of base panel 82 adjacent the corner edge of shelf element 60 and the back edge of base panel 82 adjacent the flange 66, respectively. For example, in the exemplary preferred embodiment, releasable attachment means 88 and 89 are provided on hyperextended seams 84 and 86, respectively, and comprise hook and loop fastener systems. When shelf element 60 is in its first position, hook and loop fasteners 88 and 89 attach hyperextended seams 84 and 86 to supporting panel 64, adjacent the edge of shelf element 60, and to flange 66, respectively, as shown in FIG. 13*a*. The excess dimension of base panel 82 of the shelf pouch 80 provides a space above shelf panel 62 under base panel 82 for accommodation of small objects such as a wrench set or supply materials. Hyperextended hem 84 is made broader than hem 86 to allow base panel 82 to remain in parallel relation to shelf panel 62. Additional releasable attachment means, in the exemplary embodiment, hook and loop fastener 87, is provided on back panel 12, so that, when shelf element 60 is in the second position, hyperextended hems 84 and 86 may be attached to flange 66, and to back panel 12 adjacent the corner edge of shelf element 60, respectively, as shown in FIG. 13*b*. In this configuration, hem 84 is rolled as shown to allow base panel 82 to remain in parallel relation to shelf panel 62. When tool pack 10 is in the open position, all tool holders 36, 37, 38, 39, and 40, together with shelf pouch 80, shelf panel 62 and a protected area on bottom panel 13 beneath shelf panel 62, are readily accessible.

When shelf element 60 is mounted in its first position, shelf element 60 provides support for shelf pouch 80 while shelf panel 62 and supporting panel 64 define an enclosed storage space for retaining, for example, larger supplies or special tools needed for a specific project. When shelf element 60 is mounted in its second position, shelf panel 62 provides a supporting surface for tools and supplies and a space beneath shelf element 62 on bottom panel 13 which is readily accessible from the front of the tool pack yet is protected from the weight of tools and equipment above. When it is desired to accommodate large objects in the pack, the entire shelf element 60, shelf pouch 80, and possibly one or more of the tool holders 36, 37, 38, 39 and 40 can be removed to increase available space in the tool protective compartment.

In the preferred embodiment, side panels 16 and 17 are equipped with strap attachment fittings 90 which attach strap 92 to the tool pack so that, when the pack is in the closed configuration, the strap may be placed over the shoulder and across the chest of a user to allow the pack to be carried bandelero style with both hands free to facilitate accessing difficult to reach work areas, for example, by climbing a ladder. Strap 92 may be made of any suitable, flexible material, for example, leather or heavy cotton fabric.

While an exemplary tool pack embodying the present invention has been shown and described, it will be understood that, of course, the invention is not limited to that embodiment. Modification may be made by those skilled in the art, particularly in light of the foregoing teachings. For example, shoulder straps may be provided on back panel 13 so that tool pack 10 can be carried on a user's back in the manner of a knapsack. It is, therefore contemplated by the following claims to cover any such modification which incorporates the essential features of the invention without departing from the inventive concepts herein.

I claim:

1. A tool pack for repair personnel adapted for carrying work items such as tools, equipment, parts and the like comprising:

a back panel having a front surface, a back surface, a back panel upper edge portion, a back panel lower edge portion and first and second back panel side edge portion, said back panel defining a back of the tool pack;

a bottom panel having a bottom panel rear edge portion rigidly attached to the back panel lower edge portion, said bottom panel extending forwardly of said back panel to define a base for the tool pack;

a lid member including a top panel portion defining a top for the tool pack, said lid member pivotally mounted to the back panel upper edge portion and pivotable between a closed position in which the lid member extends forwardly of said back panel in a position above said bottom panel and an open position in which the lid member extends rearwardly of said back panel, said top panel having a first surface facing the bottom panel when the lid member is in the closed position;

first and second door members, said first door member having a first front panel and a first side panel attached to one another and a first door rear edge portion opposite said first front panel, said first door member pivotally mounted along said first door rear edge portion to the first back panel side edge portion, and said second door member having a second front panel and a second side panel rigidly attached to one another and a second door rear edge portion opposite said second front panel with said second door member pivotally mounted along said second door rear edge to the second back panel side edge portion, said first and second door members pivotable between a door closed position and a door open position wherein said first and second front panels in the door closed position extend in spaced relation in front of said front surface to define at least a portion of a front of the tool pack and wherein said side panels extend forwardly of said back panel to define sides of said tool pack and wherein said side panels in the door open position extend rearwardly of said back panel, said first and second door members each having top edge portions which are movable into abutting relation with said lid member when said lid member is in the open position and said first and second door members are moved into the door open position; and means for releasably securing the lid member to each of said first and second door members when said lid member is in the open position and when the first and second door members are in the door open position whereby said door members support the lid member above a support surface on which the tool pack is placed, whereby the first and second door members in the open position help prevent the tool pack from tipping in a rearward direction when the tool pack is placed on the support surface, and whereby the lid member when in the closed position and the first and second door members when in the door closed position enclose a compartment in which to store and carry the work items.

2. A tool pack as in claim 1 in which said first and second front panels include a first and second lower door panel edge and a first and second door flange, respectively, said first and second door flange extending backwardly from said first and second lower door panel edge, respectively, toward said back panel and lying beneath said bottom panel when said door members are in the door closed position in such a manner as to lend support to said bottom panel.

3. A tool pack as in claim 1 in which said releasable securing means comprises a hook and loop fastener.

4. A tool pack as in claim 1, in which, when said lid member and said first and second door members are each in their closed position, said top panel extends outwardly beyond the first and second front panels, back panel, and first and second side panels, and said lid member further comprises a continuous perimeter skirt which extends downwardly from a perimeter of said top panel in such a manner that rain water will not enter the tool protective compartment.

5. A tool pack as in claim 1 in which said lid member comprises a continuous perimeter skirt which, when said lid is in the closed position, extends downwardly from a perimeter of said top panel and, when said lid is in the open position, extends upwardly from said perimeter in such a manner that, when said top panel is in the open position and an interior surface of said lid is utilized as a work surface, said skirt will prevent small objects from being shoved off the edges of the interior surface.

6. A tool pack as in claim 1 further comprising a continuous perimeter wall extending upwardly from a perimeter of said bottom panel in such a manner that said wall and said bottom panel form a vessel to prevent water from entering said tool protective compartment when the tool pack is set on its base on a water bearing surface.

7. A tool pack as in claim 6 in which said first and second door members each extend downwardly beyond an upper edge of said continuous perimeter wall in such a manner that rain water will not enter the tool protective compartment.

8. A tool pack as in claim 7 in which said first and second door members extend downwardly to a first and second lower door edge, respectively, said first and second lower door edge lying in a plane defined by said bottom panel.

9. A tool pack as in claim 1 further comprising:

a shelf element having a support panel and a shelf panel rigidly joined along a corner edge, said shelf panel having a flange along a distal edge, said flange lying in a plane normal to said shelf panel so that said support panel, shelf panel and flange have a generally Z-shaped cross section, said support panel having a foot edge generally parallel to said corner edge;

first attachment means for releasably attaching said flange to said front surface of said back panel in such a manner that said foot edge of said support panel may rest on a forward edge portion of said bottom panel in such a manner that said attachment means and said support panel may support said shelf panel in spaced apart generally parallel relation to said bottom panel with a load placed upon said shelf panel.

10. A tool pack as in claim 9 further comprising:

a second attachment means for releasably attaching a portion of said support panel adjacent said corner edge of said forward surface of said back panel in such a manner that said support panel lies adjacent said back panel, said foot edge rests on said bottom panel rear edge portion, and said shelf panel extends forwardly from said back panel generally parallel to said base panel.

11. A tool pack as in claim 10 further comprising:

a shelf pouch adapted to rest upon said shelf panel, said shelf pouch including a base panel with a first and second edge, a third attachment means for releasably attaching said first edge of said base panel adjacent said corner edge and a fourth attachment means for releasably attaching said second edge of said base panel adjacent said distal edge.

12. A tool pack as in claim 11 in which a dimension of said base panel of said shelf pouch from said first edge to said second edge is greater than a dimension of said shelf panel from said corner edge to said distal edge so that, when said first and second edge of said base panel are attached adjacent said corner edge and said distal edge, respectively, of said shelf panel, an object may be positioned on said shelf panel beneath said base panel.

13. A tool pack as in claim 12 in which said shelf pouch has a first and second hyperextended hem at said first and second edge, respectively, and said third attachment means attaches said first hem to said support panel and said fourth attachment means attaches said second hem to said flange.

14. A tool pack as in claim 13 in which said third and fourth attachment means include hook and loop fasteners.

15. A tool pack as in claim 12 in which said shelf pouch has a first and second hyperextended hem at said first and second edge, respectively, and said third attachment means attaches said first hem to said flange and said fourth attachment means attaches said second hem to said back panel.

16. A tool pack as in claim 15 in which said third and fourth attachment means include hook and loop fasteners.

17. A tool pack as in claim 1 in which said front panel portion of each of said first and second door members are rigidly joined to said first and second side panel, respectively.

18. A tool pack as in claim 1 in which said front panel portion of each of said first and second door members are joined to said first and second side panel, respectively, by pivotal joining means so that said front panel portion may pivot to a position generally adjacent said side panel.

19. A tool pack as in claim 1 in which said first and second back panel edge portions include first and second forward extending edge portions extending to a first and second distal edge, respectively;

said first door rear edge is pivotally mounted to said first distal edge and said second door rear edge is pivotally mounted to said second distal edge, such that, when said first and second door members are in the door closed position said forward extending edge portions define a portion of the sides of said tool pack.

20. A tool pack as in claim 1 further comprising:

a carrying strap; and first and second attachment means for attaching a first and second end of said carrying strap to said first and second side panel, respectively.

21. A tool pack as in claim 20 in which said carrying strap is of sufficient length to allow a person to cross the strap over their body, bandelero style, to carry said tool pack with their hands free.

22. A tool pack as in claim 1 further comprising: holder means for holding work materials; and holder attachment means for releasably attaching said holder means to an interior surface of said compartment.

23. A tool pack as in claim 22 in which said holder attachment means comprises hook and loop fasteners.

24. A tool pack as in claim 22 in which said tool holder comprises:

a pouch-like body defining a tool retaining cell open at a top end for access;

an enclosure flap for covering said top end;

fifth releasable attachment means for attaching said flap to said body so that said flap covers said top end; and sixth attachment means for attaching said flap to an interior surface of said compartment so that said flap is prevented from covering said top end thereby facilitating access to said tool retaining cell.

25. A tool pack as in claim 1 further comprising a perimeter wall extending upwardly from a perimeter of said bottom panel in such a manner as to confine objects resting upon said bottom panel when said door members are in the door open position, said perimeter wall comprising scuppers to allow water to drain from said bottom panel.

26. A tool pack as in claim 25 further comprising a flange extending downwardly from said perimeter of said bottom panel in such a manner as to elevate said base above a supporting surface.

27. A tool pack as in claim 1, further comprising a flange extending downwardly from a perimeter of said bottom panel in such a manner as to elevate said base above a supporting surface.

28. A tool pack for repair personnel adapted for carrying work items such as tools, parts and the like, comprising:

a shape retaining, generally rectangular, box-like outer shell having a back panel, a front panel, a top panel, a first side panel, a second side panel, and a bottom panel, each of said panels of generally rectangular shape, said bottom panel rigidly fixed to said back panel and extending forward from said back panel;

a first door member including such first side panel and an adjacent first half of said front panel joined at a front edge;

a first means for pivotally attaching a back edge portion of said first side panel to a first edge portion of said back panel in such a manner that said first door member can pivot about said first pivotal attachment means between a closed position and an open position;

a second door member including said second side panel and an adjacent second half of said front panel joined at a front edge;

a second means for pivotally attaching a back edge portion of said second side panel to a second edge portion of said back panel in such a manner that said second door member can pivot about said second pivotal attachment means between a closed position and an open position;

a lid member including said top panel;

a third means for pivotally attaching a back edge portion of said lid member to a top edge portion of said back panel such that said lid member may rotate between a closed position and an open position;

said first door member, said second door member, and said lid member arranged such that, when each is in the closed position, said first door member, said second door member, and said lid member, together with said back and bottom panels, define said box-like shell and an enclosed tool protective compartment with said first half of said front panel and said second half of said front panel extending inwardly from the first and second side panels, respectively, toward one another to abut and define a continuous front panel, and when said first door member, said second door member, and said lid member are each in their open position said first half of the front panel and said second half of the front panel extend outwardly from the first and second panels, respectively, and away from one another and a top edge portion of each of said first side panel and said second side panel lie adjacent a first and second edge portion, respectively, of said lid member;

first means for releasably attaching the top edge of said first side panel to said first edge of said lid member when said first door member and said lid member are each in their open position; and second means for releasably attaching the top edge of said second side panel to said second edge of said lid member when said second door member and said lid member are each in their open position.

29. A tool pack as in claim 28 in which said first, second and third pivotal attachment means each comprise a flexible plastic sheet.

30. A tool pack as in claim 28 in which said first pivotal attachment means comprises a piano hinge.

31. A tool pack as in claim 28, in which, when said lid member and said first and second door members are each in their closed position, said top panel extends outwardly beyond the first and second front panels, back panel, and first and second side panels, and said lid member further comprises a continuous perimeter skirt which extends downwardly from a perimeter of said top panel in such a manner that rain water will not enter the tool protective compartment.

32. A tool pack as in claim 28 in which said lid member comprises a continuous perimeter skirt which, when said lid is in the closed position, extends downwardly from a perimeter of said top panel and, when said lid is in the open position, extends upwardly from said perimeter in such a manner that, when said lid is in the open position and an interior surface of said top panel utilized as a work surface, said skirt will prevent small objects from being shoved off the edges of the interior surface.

33. A tool pack as in claim 28 further comprising a continuous perimeter wall extending upwardly from a perimeter of said bottom panel in such a manner that said wall and said bottom panel form a vessel to prevent water from entering said tool protective compartment when the tool pack is set upon a water bearing surface.

34. A tool pack as in claim 33 in which said first and second door members each extend downwardly beyond an upper edge of said continuous perimeter wall in such a manner that rain water will not enter the tool protective compartment.

35. A tool pack as in claim 28 in which said means for releasably attaching said first and second door members to said first and second lid member edges, respectively, comprise a loop and hook fastener.

36. A tool pack as in claim 28 further comprising:

a shelf element having a support panel and a shelf panel joined along a corner edge to form a right angle, said shelf panel having a flange along a distal edge, said flange lying in a plane normal to said shelf panel so that said support panel, shelf panel and flange form a generally Z-shaped cross section, said support panel having a foot edge parallel to said corner edge;

first attachment means for releasably attaching said flange to said back panel in such a manner that said foot edge of said support panel may rest on said bottom panel, and said attachment means and said support panel may support said shelf panel in parallel relation to said bottom panel with a load placed upon said shelf panel.

37. A tool pack as in claim 36 further comprising:

a second attachment means for releasably attaching a portion of said support panel adjacent said corner edge to said back panel in such a manner that said support panel lies adjacent said back panel and said foot edge rests on said bottom panel such that said shelf panel is supported extending away from said back panel generally parallel to said bottom panel.

38. A tool pack as in claim 37 further comprising:

a shelf pouch adapted to rest upon said shelf panel, said shelf pouch including a base panel with a first and second edge, a first means for releasably attaching said first edge of said base panel adjacent said corner edge and a second means for releasably attaching said second edge of said base panel adjacent said distal edge.

39. A tool pack as in claim 38 in which a dimension of said base panel of said shelf pouch from said first edge to said second edge is greater than a dimension of said shelf panel from said corner edge to said distal edge so that, when said first and second edge of said base panel are attached adjacent said corner edge and said distal edge, respectively, of said shelf panel, an object may be positioned on said shelf panel beneath said base panel.

40. A tool pack as in claim 39 in which said shelf pouch has a first and second hyperextented hem at said first and second edge, respectively, and said third attachment means attaches said first hem to said support panel and said fourth attachment means attaches said second hem to said flange.

41. A tool pack as in claim 39 in which said first hyperextended hem is broader than said second hyperextended hem.

42. A tool pack as in claim 39 in which said shelf pouch has a first and second hyperextended hem at said first and second edge, respectively, and said third attachment means attaches said first hem to said flange panel and said fourth attachment means attaches said second hem to said back panel.

43. A tool pack as in claim 42 in which said third and fourth attachment means include hook and loop fasteners.

44. A tool pack as in claim 42 in which said third and fourth attachment means include hook and loop fasteners.

45. A tool pack as in claim 28 in which said front panel half of each of said first and second door members are joined to said first and second side panel respectively by pivotal joining means so that said front panel portion may pivot to a position generally adjacent said side panel.

46. A tool pack as in claim 28 further comprising:

a carrying strap; and first and second strap attachment means for attaching a first and second end of said carrying strap to said first and second side panels, respectively.

47. A tool pack as in claim 28 further comprising;

holder means for holding tools; and holder attachment means for releasably attaching said holder means to an interior surface of said compartment.

48. A tool pack as in claim 45 in which said pivotal joining means comprises a flexible plastic strip.

49. A tool pack as in claim 46 in which said carrying strap is of sufficient length to allow a person to cross the strap over their body, bandelero style, to carry said tool pack with their hands free.

50. A tool pack as in claim 47 in which said tool holders comprise:

a pouch-like body defining a tool retaining cell open at a top end for access;

an enclosure flap for covering said top end; and flap-body means for releasably attaching said flap to said body so that said flap covers said top end;

flap-shell attachment means for releasably attaching said flap to an interior of a panel of said shell so that said flap is prevented from covering said top end thereby facilitating access to said cell.

51. A tool pack as in claim 28 further comprising a perimeter wall extending upwardly from a perimeter of said bottom panel in such a manner as to confine objects resting upon said bottom panel when said door members are in the door open position, said perimeter wall comprising scuppers to allow water to drain from said bottom panel.

52. A tool pack as in claim 28, further comprising a flange extending downwardly from a perimeter of said bottom panel in such a manner as to elevate said base above a supporting surface.

53. A tool pack as in claim 52 further comprising a flange extending downwardly from said perimeter of said bottom panel in such a manner as to elevate said base above a supporting surface.

54. A tool pack as in claim 28 in which said first and second front panels include a first and second lower door panel edge and a first and second door flange, respectively, said first and second door flange extending from said first and second lower door panel edge, respectively, backwardly toward said back panel and lying beneath said bottom panel when said door members are in the door closed position in such a manner as to lend support to said bottom panel.

* * * * *